US005458358A

United States Patent [19]

Garcin et al.

[11] Patent Number: 5,458,358

[45] Date of Patent: Oct. 17, 1995

[54] GLIDING BOARD ESPECIALLY FOR ALPINE SKIING

[75] Inventors: Pierre Garcin, Rumilly; Dominique Vuarier, Saint-Jorioz, both of France

[73] Assignee: Salomon S.A., Metz-Tessy, France

[21] Appl. No.: 215,725

[22] Filed: Mar. 22, 1994

[30] Foreign Application Priority Data

Apr. 8, 1993 [FR] France ..... 93 04400

[51] Int. Cl.[6] ..... A63C 5/14

[52] U.S. Cl. ..... 280/610; 280/608

[58] Field of Search ..... 280/607, 608, 280/609, 610

[56] References Cited

U.S. PATENT DOCUMENTS

| | | | |
|---|---|---|---|
| 4,961,592 | 10/1990 | Diard et al. . | |
| 5,033,765 | 7/1991 | Cagneux et al. | 280/610 X |
| 5,173,226 | 12/1992 | Cazaillon et al. . | |
| 5,186,777 | 2/1993 | Perenon et al. | 280/610 X |
| 5,333,889 | 8/1994 | Piegay et al. | 280/607 X |
| 5,335,931 | 8/1994 | Lacroix et al. | 280/607 X |

FOREIGN PATENT DOCUMENTS

| | | | |
|---|---|---|---|
| 0419779 | 4/1991 | European Pat. Off. . | |
| 0428886 | 5/1991 | European Pat. Off. . | |
| 0428885 | 5/1991 | European Pat. Off. | 280/610 |
| 1124600 | 10/1956 | France . | |
| 2611517 | 9/1988 | France . | |
| 2618078 | 1/1989 | France . | |
| 2660385 | 10/1991 | France . | |

*Primary Examiner*—Brian L. Johnson

*Attorney, Agent, or Firm*—Sandler, Greenblum & Bernstein

[57] ABSTRACT

The invention concerns a ski for gliding on the snow. The ski includes a longitudinal beam whose front end is turned up to form the shovel. The ski has a box structure on a portion of its length, and a sandwich structure on its remaining length. Preferably, the ski has a box structure at least in its median zone of the middle sole, and a sandwich structure at least in one of the front or rear zones.

19 Claims, 5 Drawing Sheets

GLIDING BOARD ESPECIALLY FOR ALPINE SKIING

BACKGROUND OF THE INVENTION

1. Field of the Invention

The present invention concerns a ski which is intended to glide on the snow and ice. Such a ski can be used especially for alpine skiing.

The invention also concerns more generally, any board intended to glide on the snow, such as a snowboard or a monoski, for example.

2. Discussion of Background and Material Information

Currently known skis of the aforementioned type are generally in the shape of an elongated beam, whose front end is turned up to form the shovel. They comprise a bottom gliding surface, or sole, as well as a top surface. These two surfaces are connected to one another by two lateral edges or side surfaces. The usually metallic running or bottom edges are further located at the junction between the lateral edges and the bottom surface. Usually, the binding elements are assembled at the top surface of the ski, in its central zone.

Present day skis are obtained according to one or the other of two conventional composite structures, a sandwich structure or a box structure.

A ski having a sandwich structure is described in French Patent Publication No. 1,124,600 (FIGS. 1 and 2), for example. Such a ski has a central core which is obtained in a fibrous or alveolar material, for example. The core is covered on the top and bottom by upper and lower reinforcement layers or walls.

It is known that the sandwich structure skis are well adapted to various conditions of use, whose operation is easy and forgiving. However, such skis have the disadvantage of not possessing high lateral gripping qualities in the turns and on inclines.

A box structure ski is described especially in French Patent Publication No. 1,124,600 (FIG. 3). Such a ski has a core which can be made of fibrous or alveolar material. The core is covered on its top, bottom and lateral surfaces by reinforcement layers or walls which constitute a box.

Such a structure provides the ski with greater torsional rigidity. Compared with a sandwich structure ski, such a ski has higher gripping qualities. However, such skis are not as easy and forgiving in operation as the sandwich structure skis. Such box structure skis are not the best adapted to skiers with little experience.

A box structure ski is also known from the French Patent Publication No. 2,611,517, whose thickness towards the ends is less than in the middle sole zone, and whose edge inclination, with respect to a horizontal plane, is lesser towards the ends and greater in the middle sole zone. These shape characteristics tend to provide the ski with greater torsional rigidity in the central zone, and greater flexibility towards the ends of the ski. Such a ski possesses very good gripping qualities. However, it has a box structure along its entire length, and for this reason it is not optimally adapted to inexperienced skiers, because its operation requires a certain mastery on the skier's part.

SUMMARY OF THE INVENTION

One of the objects of the invention is to provide a ski that has both an easy and forgiving operation, and excellent gripping qualities on inclines and in turns.

Another object of the invention is to provide a ski that is produced more economically than a conventional box structure ski.

Other objects and advantages of the invention will become apparent in the following description, this description however, being given as non-limiting examples.

The ski according to the present invention is intended for gliding on the snow. It comprises a longitudinal beam with a turned up front end to form the shovel, a gliding sole and lateral running edges. It is characterized by the fact that it has a box type structure along one portion of its length, with a central core Surrounded by an upper reinforcement wall, two lateral reinforcement walls and a lower reinforcement wall, and .along another portion of its length, separate from the first portion, it has a sandwich type structure, with a central core, an upper reinforcement wall and a lower reinforcement wall.

BRIEF DESCRIPTION OF THE DRAWINGS

The invention will be better understood with reference to the following description as well as the annexed drawings which are an integral portion thereof.

DETAILED DESCRIPTION OF THE PREFERRED EMBODIMENTS

Figure 1:
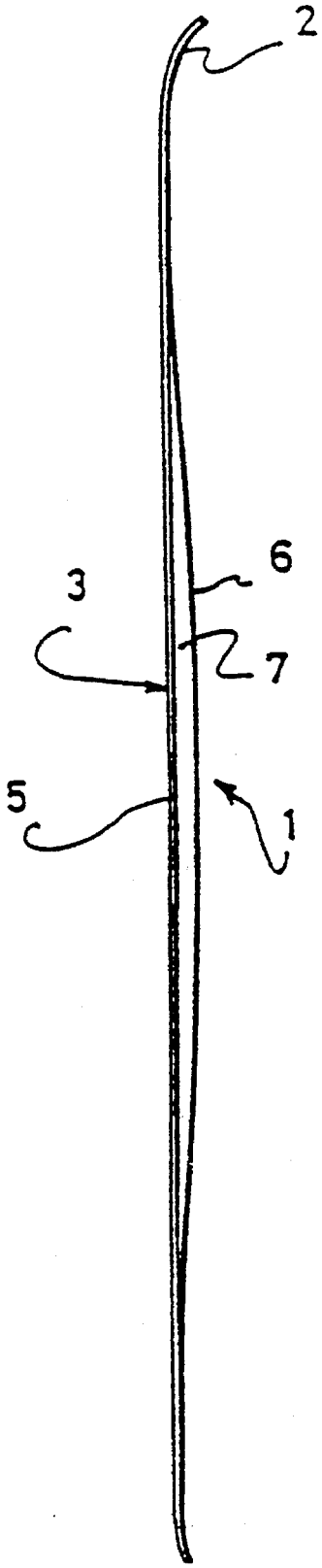
FIG. 1 represents a side view of a ski according to a first implementation of the invention.
Figure 2:
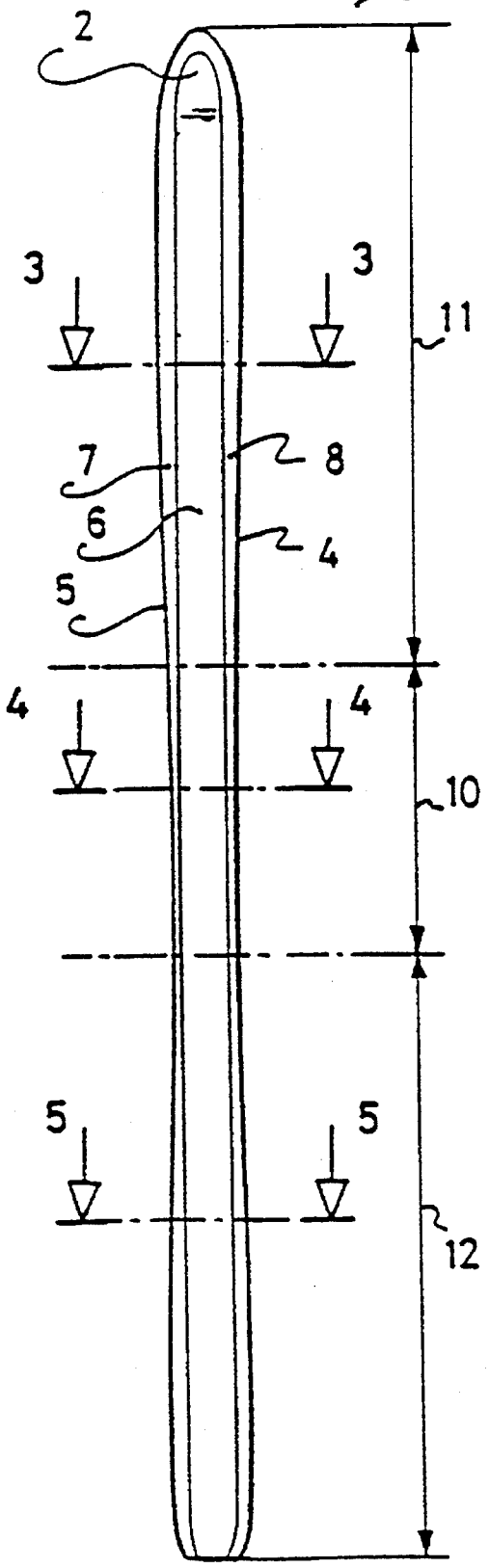
FIG. 2 is a top view of the ski represented in FIG. 1.

The ski 1 shown in FIGS. 1 and 2 generally represents the shape of a beam elongated along a longitudinal direction, whose front end 2 is turned up to form the shovel. In a known fashion, the ski 1 has a bottom surface or sole 3, which is laterally bordered by two running edges 4 and 5.

The ski 1 further has a top surface 6, and two lateral edges 7 and 8 which connect the top surface 6 to the sole 3, or more precisely, to the running surfaces 4 and 5.

A central zone 10 of the ski is referenced in FIG. 2. It is in this zone that the binding elements are assembled, and that the boot rests in support on the ski. The greatest portion of the pressures that the ski exerts on its gliding surface is also focussed in this zone.

In front of the central zone 10, the ski has a front zone 11 and a rear zone 12. Therefore, the ski 1 has three zones 10, 11 and 12.

According to the invention, the ski 1 has a box structure in at least one of the zones 10, 11, 12, and a sandwich structure in the remaining zone or zones. Preferably, the ski has a box structure at least in the central zone 10.

According to a first implementation represented in FIGS. 1 to 9, the ski has a box structure in the central zone 10, and a sandwich structure in the zones 11 and 12, i.e., towards the ends.

Figure 3:
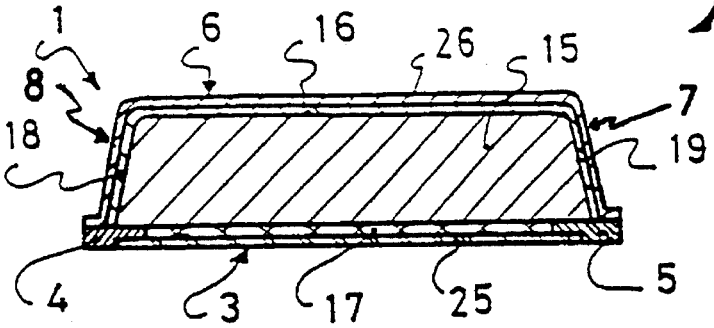
FIG. 3 is a sectional view of a transverse section of the ski along line 3—3.
Figure 4:
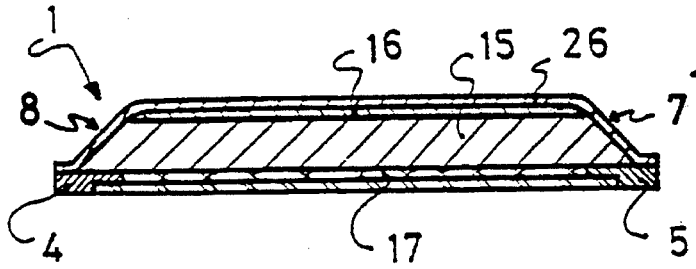
FIG. 4 is a similar view at the level of line 4—4.
Figure 5:
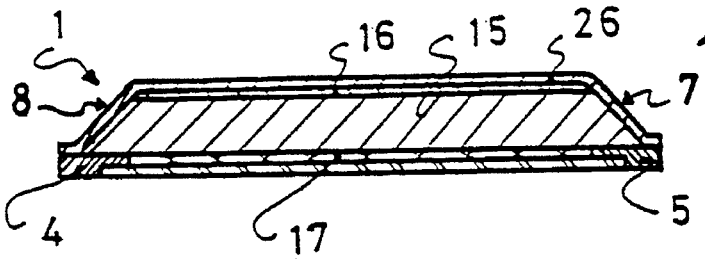
FIG. 5 is a similar view at the level of line 5—5.

FIGS. 3 to 5 show transverse sections of the ski 1, at the sectional lines 4—4, 3—3, 5—5 respectively, which are located in the zones 10, 11 and 12.

These figures also show that the ski has a central core 15 which extends substantially along its entire length. The core 15 is of any appropriate type; it is especially obtained in a fibrous material such as wood, or reciprocally adhered wooden slats, or any other known structure, an alveolar structure, for example. Sectionally, the core 15 has a trapezoidal shape. In addition, the dimensions of a transverse section of the core can be variable along the length of the ski. The structure, shape and dimensions of the core are non-limiting for the invention.

With reference to FIG. 3, the ski 1 has a box structure in its central zone 10. In this zone, the four surfaces of core 15 are surrounded by reinforcement layers or walls, an upper reinforcement wall 16, a lower reinforcement wall 17, and two lateral reinforcement walls 18 and 19. The lateral reinforcement walls 18, 19 extend downwardly from the upper reinforcement wall 16 along substantially the entire height of respective ones of the lateral surfaces 7, 8 of the ski.

The upper 16 and lower 17 reinforcement walls are of any appropriate type, such as plates made of a light alloy for example, such as a high performance aluminum alloy. The lateral reinforcement walls can be made of a composite structure constituted by fibers coated with thermohardenable material such as an epoxy resin, or polyester, or also with thermoplastic material. The upper and lower reinforcement walls can also be made of such a composite structure.

With reference to FIGS. 4 and 5, the ski 1 has a sandwich structure in its front zone 11 and its rear zone 12. In these zones, only the top and bottom surfaces of the core 15 are covered by upper and lower reinforcement walls. The lateral surfaces of the core 15 are not covered by any reinforcement wall in these zones.

In this way, the central zone 10 with its box structure provides the ski with very good gripping qualities, especially in the turns, and, by virtue of their greater flexibility, the front and rear zones provide the ski with an easy and forgiving operation.

Advantageously, the previously described reinforcement walls 16 and 17 extend continuously along the entire length of the ski, forming the upper and lower reinforcement walls of the box and sandwich structure zones. The lateral reinforcement walls 18 and 19 are only present locally in the central zone 10.

Figure 6:
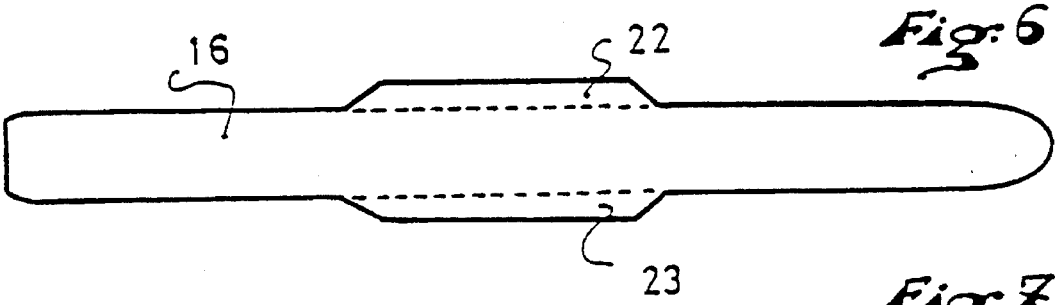
FIG. 6 is a planar representation of the upper reinforcement wall and the two lateral reinforcement walls according to a first implementation of the invention.
Figure 7:
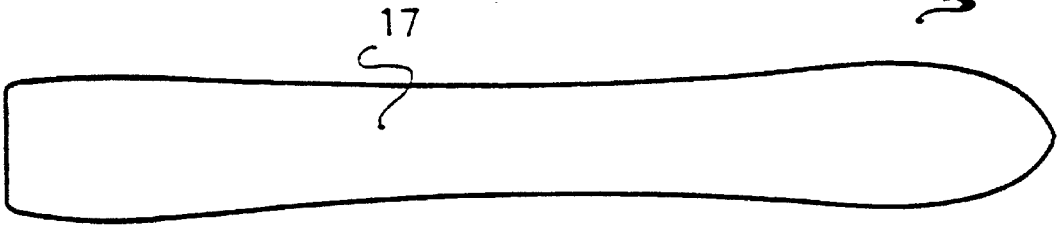
FIG. 7 represents a top view of the lower reinforcement wall.

FIGS. 6 and 7 represent a developed first embodiment of the reinforcement walls. According to this embodiment shown, the upper reinforcement wall 16 has an approximately constant width, except in its median zone corresponding to the middle sole zone 10, where it is continuously laterally extended by two lateral extensions 22 and 23. After folding along the lines schematized by the dotted lines, these extensions 22 and 23 form the lateral reinforcement walls 18 and 19. Preferably, as is visible in FIG. 8, the lateral extensions 22 and 23 have a trapezoidal shape, so as to better distribute the linkage stresses between the different zones.

This is non-limiting, and the lateral extensions could have any other appropriate shape, such as a general parallelepiped shape.

FIG. 7 represents a top view of the lower reinforcement wall 17. In this illustrated embodiment, the width of this reinforcement wall is greater than that of the upper reinforcement wall 16 and, in addition, is less in the central zone 10 than towards the ends, providing the ski with a narrow waist.

According to the embodiment illustrated in FIGS. 3 to 5, the lower reinforcement wall 17 is located between the running edges 4 and 5, and in their lower portions, the lateral walls 18 and 19 are connected to the running edges 4 and 5. In addition, the ski has a lower layer 25 located under the wall 17, which constitutes the gliding sole. The ski has a decorative layer 26 on the top and sides.

Figure 8:
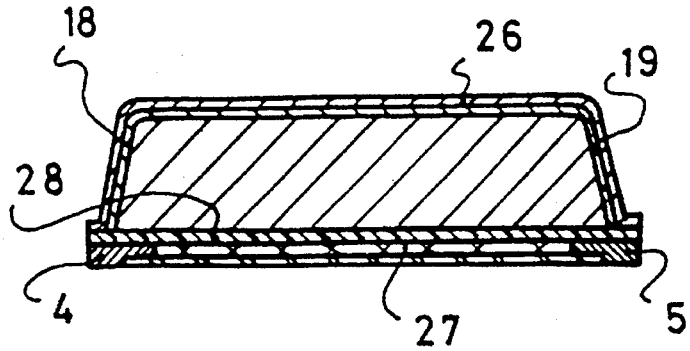
FIGS. 8 and 9 correspond to construction variations of the ski in its central zone.

The layer 25 is of a known type, made of polyethylene, for example. Similarly, the decorative layer is of a known type; it is obtained in ABS, polyamide or polycarbonate, for example. In addition, it can have surface details that are raised with respect to other portions of the decorative layer; and FIG. 8 represents a construction variation of the central zone 10 of the ski, i.e., the box structure zone. According to this variation, the ski has a double lower reinforcement wall, i.e., a wall 27 similar to the previous wall 17, and a wall 28 which covers both the wall 27 and the lateral running edges 4 and 5. The lateral walls 18 and 19 are connected here to the lateral edges of the wall 28.

Figure 9:
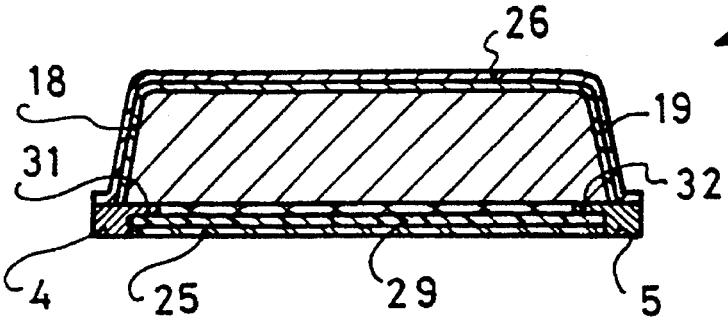

FIG. 9 represents another construction variation in which the lower wall 29 is lowered with respect to the wall 17, and is laterally engaged under the edges 31 and 32 of running edges 4 and 5, towards the inside of the ski. As in the embodiment of FIG. 3, the lateral walls 18 and 19 are downwardly connected to the running edges 4 and 5.

FIGS. 10 to 13 illustrate a construction variation of the previously described ski.

Figure 10A:
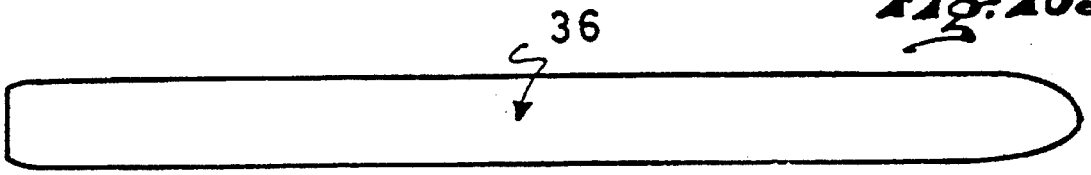
FIGS. 10*a* and 10*b* represent an embodiment variation of the upper reinforcement wall and the lateral reinforcement walls.
Figure 10B:
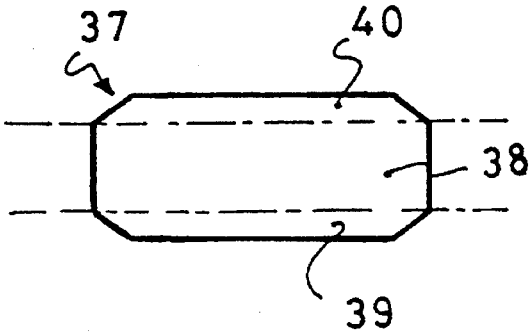

FIG. 10*a* shows the upper reinforcement wall 36 of the ski, in the form of a band of substantially constant width along its entire length. FIG. 10*b* shows another band 37, whose overall length corresponds to the length of the median zone 10 of the ski. This band 37 comprises a central portion 38 of substantially the same width as the band 36, and two lateral extensions 39 and 40, which, after folding around the lines schematized by the dotted lines, constitute the lateral reinforcement walls of the ski in its box structure zone.

Figure 11:
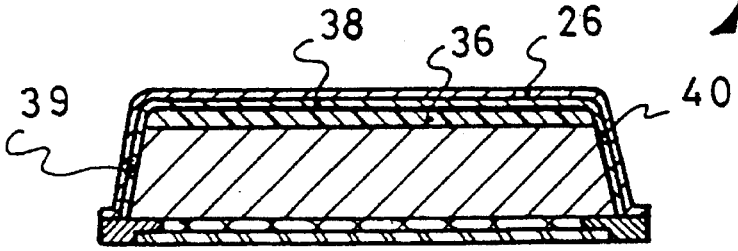
FIGS. 11 and 12 are transverse sectional views of the middle sole of a ski, and illustrate relative arrangements of the two elements represented in FIGS. 10*a* and 10*b*.

FIG. 11 shows a transverse section of the ski in its box structure zone, according to a first relative arrangement of the bands 36 and 37. According to this arrangement, the band 37 has its central portion 38 which is positioned above the band 36, in the central zone 10 of the ski.

Figure 12:
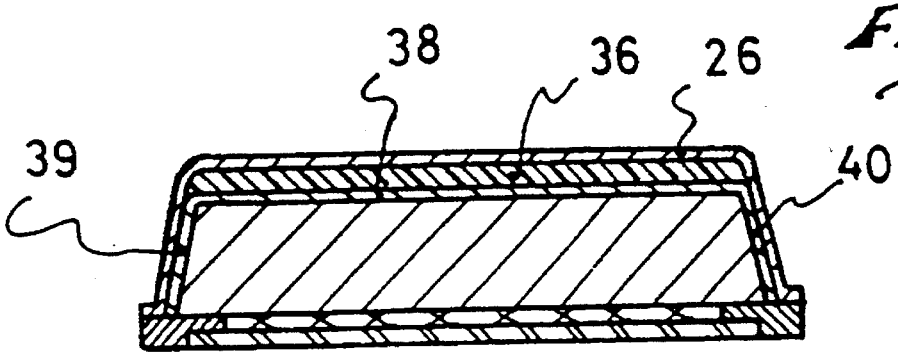

According to another arrangement shown in FIG. 12, the band 36 passes over the central portion 38 of the band 37.

In both cases, it must be noted that the portion 38 reinforces the structure of the ski in its central zone where the binding elements are assembled.

Figure 13:
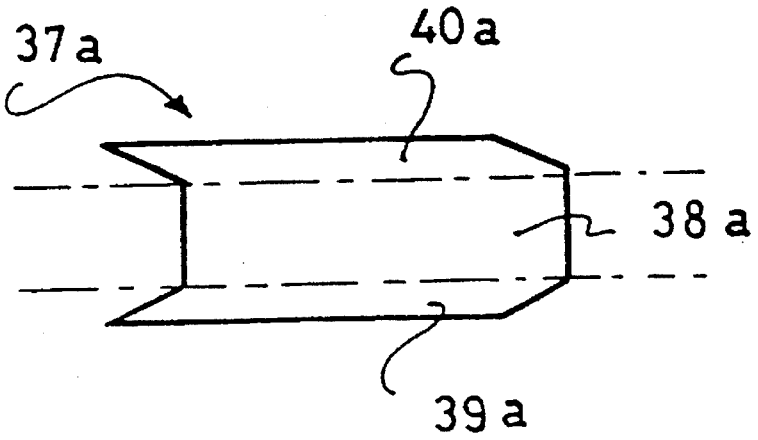
FIG. 13 is an embodiment variation of the element represented in FIG. 10*b*.

FIG. 10*b* shows the lateral extensions 39 and 40 in a trapezoidal shape, so as to have a good distribution of the forces at the level of the linkages between the different zones. However, this shape is non-limiting, and FIG. 13 shows a variation to this effect, according to which the band 37*a* has a central zone 38*a* and extensions 39*a* and 40*a* in a general shape of a parallelogram.

In the different embodiments described above, the inclination of the lateral surface of the ski can be constant or variable along the entire length thereof. In addition, the lateral surfaces can be planar, substantially planar, or else concave or convex along all or part of their length.

Figure 14:
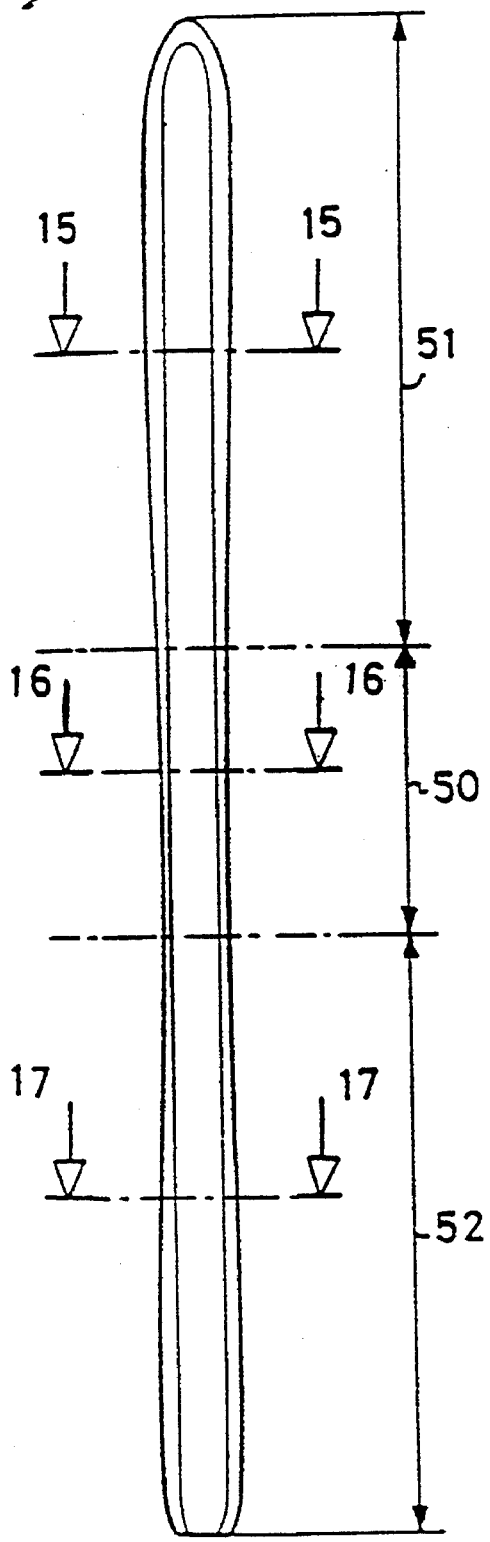
FIG. 14 represents a top view of a ski according to another implementation of the invention.
Figure 15:
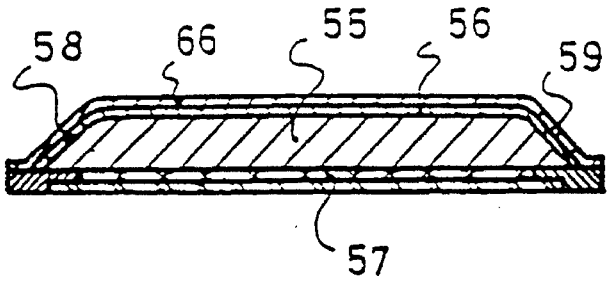
FIGS. 15 to 17 represent various transverse sections of the ski of FIG. 14, at the level of lines 15—15, 16—16, 17—17 respectively.
Figure 16:
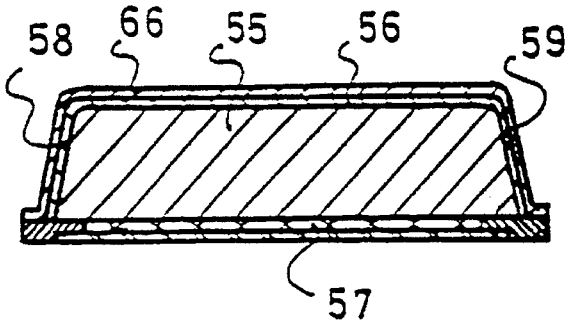
Figure 17:
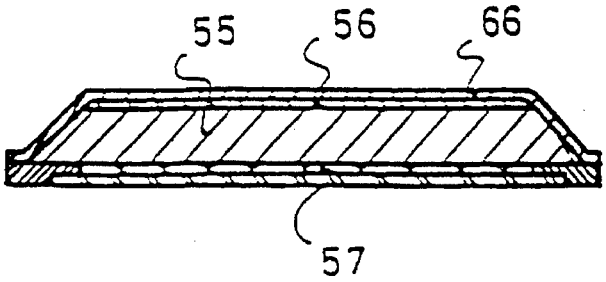

FIGS. 14 and 17 show an implementation variation of the invention. According to this variation, the ski has a continuous box structure in its central zone 50 and its front zone 51. It further has a sandwich structure in its rear zone 52. FIGS. 15 and 17 respectively show transverse sections of the ski of FIG. 14 at the lines 15—15, 16—16, 17—17. FIGS. 15 and 16 show a similar structure, at near actual dimensions, with a core 55, an upper reinforcement wall 56, a lower reinforcement wall 57, and two lateral reinforcement walls 58 and 59. FIG. 17 shows the rear structure of the ski, with the core 55, and the upper and lower walls constituted by the extensions of the walls 56 and 57, respectively, from the central zone 50. In this zone, the core is not covered by any lateral reinforcement wall. FIGS. 15 to 17 further show an outer decorative layer 66 which is of a type similar to the previous layer 26. This layer extends along the entire length of the ski.

In this way, the ski possesses excellent gripping qualities in the central zone 50 and the front zone 51. The more flexible rear zone 52 provides the ski with a forgiving operation. This ski is well adapted for so-called side slip turns.

Similarly, according to another variation, the ski could have a box structure in its central and rear zones, and a sandwich structure in its front zone.

It goes without saying that the different embodiment variations of the previously described reinforcement walls apply equally for these different implementations of the invention.

Likewise, it is understood that the central zones 10, 50, comprise the mounting zone of the binding elements, in particular, the standard mounting zone. However, such zones 10, 50 are not limited to the borders of this mounting zone, and can extend beyond, frontwardly and rearwardly.

The ski according to the present invention can be manufactured by any appropriate means.

The present description is only given as an example, and one could adopt other implementations of the invention without departing from the scope thereof.

In particular, like the lateral edges, the upper reinforcement wall could be inclined with respect to the horizontal line, along all or part of its length, and/or have surface details that are raised with respect to other portions of the decorative layer on all or part of its surface.

Finally, the invention is applicable not only to skis used for alpine skiing, but equally to any board for gliding on the snow or ice, especially boards used for snowboarding.

Finally, although the invention has been described with reference of particular means, materials and embodiments, it is to be understood that the invention is not limited to the particulars disclosed and extends to all equivalents within the scope of the claims.

What is claimed:

1. A ski for gliding on snow, the ski comprising:

a longitudinally extending beam having a front end turned upwardly forming a shovel;

a gliding sole affixedly positioned at a lower portion of said beam to form a sliding surface for the ski;

a pair of longitudinally extending running edges positioned at opposite lower lateral sides of the ski;

said beam having a box type structure along a first portion of the beam and a sandwich type structure along another portion of the beam;

said box type structure comprising a central core surrounded by an upper reinforcement wall, two opposite lateral reinforcement walls, and a lower reinforcement wall, wherein said upper reinforcement wall, said opposite lateral reinforcement walls and said lower reinforcement wall forming a box around said core;

said sandwich type structure comprising a central core, an upper reinforcement wall above said central core and a lower reinforcement wall below said central core, wherein said upper reinforcement wall and said lower reinforcement wall, forming a sandwich with said core.

2. A ski according to claim 1, further comprising three contiguous zones, a central zone comprising a mounting zone for binding elements for securing a boot to the ski, a front zone extending towards the front and a rear zone extending towards the rear, wherein the beam has said box type structure at least in the central zone, and said sandwich type structure at least in one of the front zone and the rear zone.

3. A ski according to claim 2, wherein the beam has said box type structure in the central zone, and said sandwich type structure in both the rear zone and the front zone.

4. A ski according to claim 2, wherein the beam has said box type structure in the central zone and the front zone, and said sandwich type structure in the rear zone.

5. A ski according to claim 1, wherein the beam has, in an upper portion, a continuous upper reinforcement wall comprising two lateral continuous extensions, said extensions constituting the lateral reinforcement walls of the box structure, and wherein the lateral reinforcement walls are downwardly connected to the lower reinforcement wall, or to the running edges.

6. A ski according to claim 1, wherein the upper reinforcement wall is formed by a band of substantially constant width, and wherein the lateral walls are lateral portions of an attached element.

7. A ski according to claim 6, wherein the attached element has two lateral extensions, and a central portion which is superposed to the upper reinforcement band so as to locally form a double reinforcement thickness in an upper portion of the ski.

8. A ski according to claim 1, wherein the lateral reinforcement walls have a planar trapezoidal shape.

9. A ski according to claim 1, wherein the lateral reinforcement walls have a planar parallelepiped shape.

10. A ski comprising:

an external shape extending longitudinally from a central zone rearwardly to a rear zone and forwardly to a front zone;

a core positioned centrally within the ski and extending substantially from a front end of said front zone, through said central zone, and substantially to a rear end of said rear zone;

an upper reinforcement layer positioned above said core and extending substantially from the front end of said front zone, through said central zone, and substantially to the rear end of said rear zone;

a lower reinforcement layer positioned beneath said core and extending substantially from the front end of said front zone, through said central zone, and substantially to the rear end of said rear zone; and a pair of laterally opposed reinforcement layers, each said laterally opposed reinforcement layer being positioned laterally of a respective lateral side of said core, said pair of laterally opposed reinforcement layers extending through said central zone to confer a box construction for the ski through said central zone, said pair of laterally opposed reinforcement layers not extending along at least one of said front zone and said rear zone.

11. A ski according to claim 10, wherein said pair of laterally opposed reinforcement layers extend longitudinally only within said central zone to thereby comprise, with said upper reinforcement layer and said lower reinforcement layer, the box construction only within said central zone.

12. A ski according to claim 10, wherein the ski comprises an upper surface, a lower surface and a pair of lateral side surfaces having a predeterminate height, wherein said laterally opposed reinforcement layers extend downwardly along substantially said predeterminate height of said lateral side surfaces.

13. A ski according to claim 12, wherein said pair of laterally opposed reinforcement layers extend longitudinally only within said central zone to thereby comprise, with said upper reinforcement layer and said lower reinforcement layer, the box construction only within said central zone.

14. A ski according to claim 10, wherein the upper reinforcement layer and said laterally opposed reinforcement layers comprise a unitary reinforcement element, said laterally opposed reinforcement layers extending downwardly from an upwardly facing portion of said unitary reinforcement element to constitute opposite laterally facing portions of said unitary reinforcement element.

15. A ski according to claim 10, wherein the upper reinforcement layer comprises a longitudinally extending reinforcing band having a substantially constant width and wherein said laterally opposed reinforcement layers are lateral extensions of a second reinforcing band, said upper reinforcing band and said second reinforcing band being in an overlapping adjacent relationship along a portion of said upper reinforcing band, thereby forming a double reinforcement thickness in an upper portion of the ski.

16. A ski comprising:

an external shape extending longitudinally from a central zone rearwardly to a rear zone and forwardly to a front zone;

a core positioned centrally within the ski and extending substantially from a front end of :said front zone, through said central zone, and substantially to a rear end of said rear zone;

an upper reinforcement layer positioned above said core and extending substantially from the front end of said front zone, through said central zone, and substantially to the rear end of said rear zone;

a lower reinforcement layer positioned beneath said core and extending substantially from the front end of said front zone, through said central zone, and substantially to the rear end of said rear zone; and said upper reinforcement layer comprising a pair of continuous lateral extensions extending downwardly from above said core in a direction along respective lateral sides of said core to thereby constitute a pair of opposite lateral reinforcement layers, said continuous lateral extensions extending longitudinally in at least said central zone and in only one of said front zone and said rear zone.

17. A ski according to claim 16, wherein said upper reinforcement layer, said pair of opposite lateral reinforcement layers and said lower reinforcement layer comprising at least a portion of a box construction in at least said central zone.

18. A ski according to claim 17, wherein said pair of opposite lateral reinforcement layers are confined to said central zone, whereby the ski comprises a box construction in said central zone and a sandwich construction in only one of said front zone and said rear zone.

19. A ski according to claim 17, wherein said pair of opposite lateral reinforcement layers are located in said central zone and in said front zone, whereby the ski comprises the box construction in said central zone and in said front zone and a sandwich construction in said rear zone.

* * * * *